United States Patent [19]

Morisaki

[11] 3,980,853

[45] Sept. 14, 1976

[54] INDUCTIVE BODY FOR HIGH FREQUENCY INDUCTION HEATING

[75] Inventor: Nobukazu Morisaki, Aichi, Japan

[73] Assignee: Daido Metal Company, Ltd., Nagoya, Japan

[22] Filed: Feb. 24, 1975

[21] Appl. No.: 552,129

Related U.S. Application Data

[63] Continuation-in-part of Ser. No. 405,112, Oct. 10, 1973, abandoned.

[30] Foreign Application Priority Data

July 12, 1973 Japan ..... 48-78842

[52] U.S. Cl. ..... 219/10.79; 219/10.57

[51] Int. Cl.[2] ..... H05B 9/02

[58] Field of Search ..... 219/10.79, 10.49, 10.41, 219/10.43, 10.53, 10.57, 10.61, 10.73

[56] References Cited

UNITED STATES PATENTS

| | | | |
|---|---|---|---|
| 2,309,631 | 2/1943 | Denneen et al. | 219/10.79 |
| 3,359,398 | 12/1967 | Reinke | 219/10.79 |
| 3,772,492 | 11/1973 | Brogden | 219/10.79 |

*Primary Examiner*—E. A. Goldberg

*Attorney, Agent, or Firm*—Karl W. Flocks

[57] ABSTRACT

An inductive body for high frequency induction heating of cylindrical work piece being equipped with at least one collar portion. The inductive body has at least one gap of specific dimensions opposing the collar portion, so as to avoid local density of magnetic flux within the article to be heated.

3 Claims, 17 Drawing Figures

INDUCTIVE BODY FOR HIGH FREQUENCY INDUCTION HEATING

CROSS-REFERENCE TO RELATED APPLICATION

This is a continuation-in-part application of U.S. patent application Ser. No. 405,112 filed Oct. 10, 1973 by Nobukazu Morisaki and now abandoned.

This invention relates to an inductive body for high frequency induction heating, and more particularly to an inductive body adapted for use in high frequency induction heating of collared cylindrical articles.

It has been pointed out that, when a high frequency current is applied to induction body which is substantially surrounding the collared cylindrical article to be heated, the density of magnetic flux tends to concentrate in the collar to excessively heat the collar, resulting in uneven temperature distribution in the article.

The present invention is aiming at avoiding this drawback by providing an improved inductive body.

According to the present invention there is provided an inductive body having formed therein at least one gap such as a notch or an aperture at a portion thereof substantially opposed to the collar of the article to be heated.

Because of the presence of such gaps, excessive concentration of the density of magnetic flux in the collar can be avoided, whereby an even distribution of the magnetic flux and a resulting uniform heating in the article are effected.

The other objects and features of the present invention will become clear through the following description of the embodiments in comparison with the prior art by referring to the attached drawings.

Figure 1:
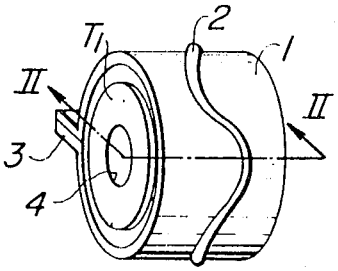
FIG. 1 PRIOR ART
FIG. 1 is a perspective view showing the important part of a conventional inductive body for high-frequency heating.
Figure 2:
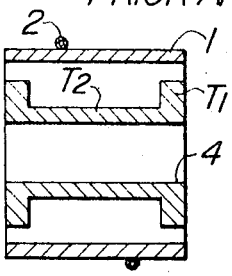
FIG. 2 PRIOR ART
FIG. 2 is a sectional view taken along the line II—II of FIG. 1.
Figure 3:
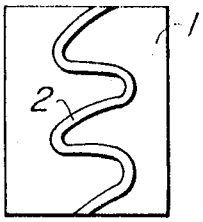
FIG. 3 PRIOR ART
FIG. 3 is a development illustrating the inductive body of FIG. 1.

As is publicly known, the inductive body for high-frequency heating is generally used in centrifugal casting machines for making slide bearings or the like. Referring to FIGS. 1 through 3, an explanation will be made here on a conventional inductive body for high-frequency heating. FIG. 1 is a perspective view of the important part of the conventional inductive body; FIG. 2 is a sectional view taken along the line II—II of FIG. 1; and FIG. 3 is a development of the cylindrical inductive body for high-frequency heating 1 shown in FIG. 1, respectively.

Cooling pipe 2 is provided on the inductive body 1. Said inductive body 1 is constructed such that it generally surrounds the whole peripheral surface of article to be heated 4. It should be noted that, when a predetermined high-frequency current is applied to bus bar 3 of the conventional inductive body 1, the density of magnetic flux at collar portions T1 of the article to be heated 4 is, in practice, still more increased. As a result, the temperature at the collar portions T1 is excessively increased as compared with the temperature at body portion T2 of the article to be heated 4. Therefore, it has not been possible in the prior art to attain uniform heating through the whole body of the article to be heated.

This invention provides an improved inductive body for high-frequency heating which can obviate such a disadvantage inherent to the prior arts.

To summarize the features of this invention, at least a notched portion or portions or apertures are arranged in the circumference or at the axial end of the circumference of the cylindrical inductive body 1 opposite to the cylindrical collar portions T1 of the article to be heated 4, thus making the density of magnetic flux applied to the collar portions T1 and density of magnetic flux applied to the body portion T2 substantially equal in amount. The article to be heated is rotated in said hollow body in relation to the hollow cylindrical inductive body. Of course, shape, position, size, number, and the other factors of the notched portion may be varied depending upon shape, size and other factors of the article to be heated. In short, the notched portion may be formed in a suitable manner to substantially equalize in amount the density of magnetic flux applied to the collar portions T1 and the density of magnetic flux applied to the body portion T2.

With reference to the accompanying drawings, an embodiment of the invention will be described in detail.

Figure 4:
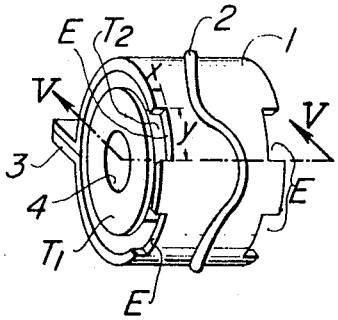
FIG. 4 is a perspective view showing the important part of an embodiment of inductive body for high-frequency heating according to the present invention.
Figure 5:
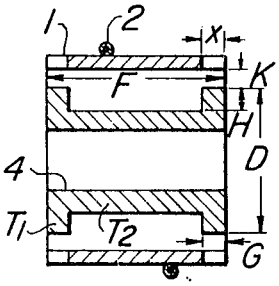
FIG. 5 is a sectional view taken along the line V—V of FIG. 4.
Figure 6:
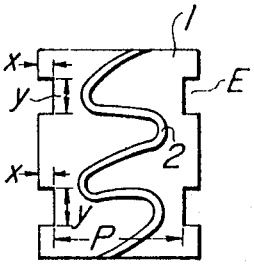
FIG. 6 is a development of the inductive body shown in FIG. 4.
Figure 8A:
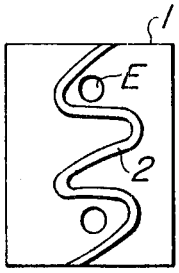
Figure 8B:
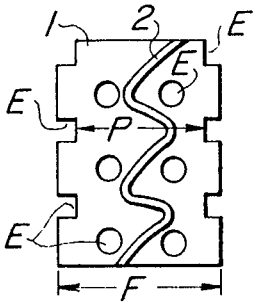
Figure 8C:
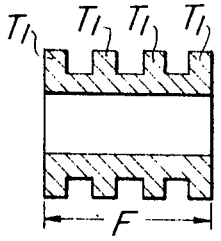
Figure 9A:
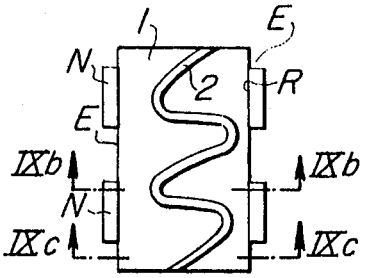
Figure 9B:
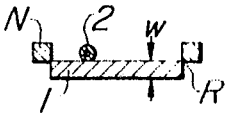
Figure 9C:
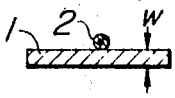
Figure 9D:
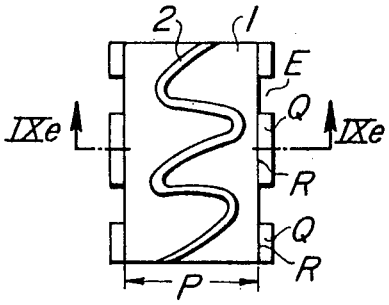
Figure 9E:
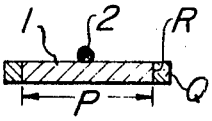
Figure 10:
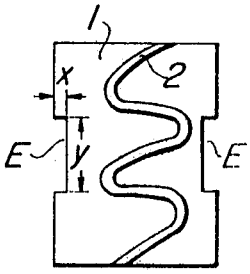

FIG. 4 is a perspective view showing the important part of an embodiment of inductive body according to the invention; FIG. 5 is a sectional view taken along the line V—V of FIG. 4; FIG. 6 is a development of the cylindrical inductive body illustrated in FIG. 4; and FIGS. 7, 8*a*, 8*b*, 9*a*, 9*d*, 10 and 11 are development illustrating the other embodiments of inductive body according to the invention. FIG. 8*c* is a sectional view; of the article to be heated having four collor portions. FIG. 8*c* is a sectional view of the article to be heated having four collars. FIGS. 9*b*, 9*c* and 9*e* are sectional views of the induction body of the present invention. For the sake of convenience of explanation, some of the notched portions are omitted from the Figures. Through the drawings, like numerals and signs designate like parts in the figure. Specified in the following are the numerals and signs used in the drawings:

1. Inductive body for high-frequency heating.
2. Cooling pipe provided on the inductive body for high-frequency heating.
3. Bus bar of the inductive body for high-frequency heating.
4. Article to be heated.

T1. Collar portion of the article to be heated.

T2. Body portion of the article to be heated.

E. Notched portion of the inductive body for high-frequency heating.

D. Outer diameter of the collar portion of the article to be heated.

G. Width of the collar portion of the article to be heated.

H. Height of the collar portion of the article to be heated.

Other signs will be described as necessity occurs.

Referring to FIGS. 4 through 6, the notched portions E suitably spaced from each other are provided on the circumference at both axial ends of the inductive body 1 opposite to the both collar portions T1 of the article to be heated. It was observed that, when a predetermined high-frequency current was applied to the bus bar 3 of the inductive body 1, the density of magnetic flux applied to the collar portions T1 of the article to be heated 4 and the density of magnetic flux applied to the body portion T2 of the article to be heated 4 were equalized in amount, thus accomplishing a uniform distribution of temperature through both the collar portions T1 and the body portion T2. On the basis of this basic idea have been developed the constructions illustrated in FIGS. 7 through 11.

Figure 7:
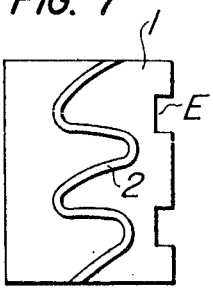
FIGS. 7 through 11 are developments or sectional views illustrating respectively other embodiments of the present invention.
Figure 11:
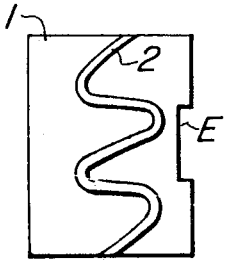

The inductive body 1 shown in FIG. 7 is used when the article to be heated has only one collar portion. In FIG. 8*a*, the inductive body 1 is shown having at a central part in the circumference thereof apertures E. This inductive body 1 is for use with a cylindrical article to be heated which is provided with a collar portion in its central part. The inductive body 1 of FIG. 8*b* has two rows of apertures E within the width F. The article to be heated for which the inductive body 1 of FIG. 8*b* is used includes, as shown in FIG. 8*c*, four collar portions. Preferably, shape of the notched portion of the inductive body 1 is rectangular when the notched portion is disposed in the axial end of the inductive body 1, and if the gapped portion is to be arranged within the width P, circular apertures are preferable for easy working by drilling operation. However, as described previously, there is no need to limit the shape of the notched portion within this manner of selection. The inductive body 1 itself illustrated in FIG. 9*a* is of conventional type the outer surfaces of both axial ends of which are attached with radially and axially extending segments N made of the same material as that of the inductive body 1. Brazing or other method may be utilized when attaching the segments N to the inductive body 1, provided that the notched portions E can be formed as shown in the figure. FIGS. 9*b* and 9*c* are sectional views taken respectively along the lines $IX_b$—$IX_b$ and $IX_c$—$IX_c$ of FIG. 9*a*. Sign w indicates the wall thickness of the inductive body. The inductive body 1 of FIG. 9*d* in a shape similar to that of the inductive body of FIG. 6 has a width P and comprises segments Q coplanarily attached thereto (R) as by brazing, which form the notched portions E as illustrated in the figure. FIG. 9*e* is a sectional view taken along the line $IX_e$—$IX_e$ of FIG. 9*d*. The inductive body of FIG. 10 has only a notched portion E in each of the axial ends of the inductive body 1. It will be easily understood that, in the same way, the notched portion E shown in FIG. 11 is constructed by forming it only at an axial end of the inductive body 1.

Now explanation will be made on the heating experiments in which was used the inductive body according to the invention.

In the experiments, the article to be heated was made of mild steel and had the following dimensions:

| | |
|---|---|
| Outer diameter D of the two collar portions: | 112 mm |
| Total length (width) F of the cylinder having the two collar portions: | 61 mm |

-continued

| | |
|---|---|
| Width G of the one collar portion: | 3.5 mm |
| Height H of the two collar portions: | 7.5 mm |

The inductive bodies 1 used in the experiments were all made of copper and the dimensions of the notched portions were as follows:

| | |
|---|---|
| Depth x of the notched portion: | 2 mm, 4 mm, 5 mm, and 0 mm (conventional inductive body). |
| Width y, namely, the circumferential length of the notched portion: | One-half the circumferential length of the inductive body, and 0 mm (conventional inductive body). |
| Distance K between the conductive body 1 and the collar portions T1: | 15 mm (see FIG. 5) |

The experiments were conducted using the inductive body and the article to be heated specified above. When the article to be heated was heated to about 1,000°C by applying a high-frequency current to the bus bar 3, the temperature difference between those of the collar portions T1 and the body portion T2 was measured, and there was obtained a relationship shown in FIG. 12. The ordinate indicates the temperature difference in Celsius scale while the abscissa indicates the value of $x$ in millimeters. As previously described, through all the experiments the value of $y$ was determined at one-half the circumferential length of the inductive body except when it was determined at 0 mm, in which case a conventional inductive body was used with the value of $x$ also being 0 mm.

Figure 12:
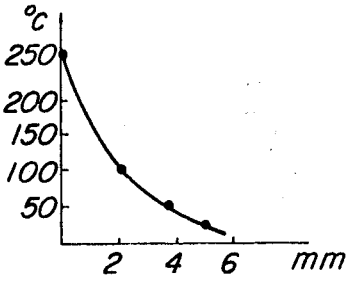
FIG. 12 is a diagram showing the relationship between the size of a notched portion and the temperature difference that exists between collar portions and a body portion of an article to be heated.

With reference to FIG. 12, it is apparent that, while the temperature difference between the collar portions T1 and the body portion T2 is 250°C when the conventional inductive body 1 is used, the temperature difference is proved to be decreased remarkably and a more uniform heating is carried out by using the inductive body according to the present invention. It is noted that, in order to minimize the temperature difference between the collar portions T1 and the body portion T2, it is necessary to make the dimensional values $x$ and $y$ of the notched portion E of the inductive body to a larger value but within the range(s) as described in the following explanation. From the results of a large number of experiments conducted, it has been known that the following are the optimum values for the size of the notched portion E. That is, to obtain the most favorable result, the value of $x$ should be in a range of one-third to four times of the width G of the collar portion of the article to be heated, and the value of $y$ (the sum $\Sigma y$ of the value of $y$ if more than one notched portions E are used) should be in a range of one-quarter to three quarters of the circumferential length of the inductive body.

A plurality of apertures of elliptical, semi-elliptical or circular shape are usually formed in the circumference of the inductive body in such numbers and size that may satisfy the requirement with respect to $x$ and $\Sigma y$ as described above.

However, a single circular, elliptical or semi-elliptical aperture may be formed provided that the opening area of said aperture lies within the range of the product of the value of $x$ and $y$ ($x.y$) or that of $x$ and $\Sigma\ y$ ($x.\Sigma y$) defined as for a rectangular notch or notches as explained above.

A bearing made of a lead-copper alloy was centrifugally cast by pouring the molten metal into the inside of a mild steel cylindrical body having two collar portions which was produced in accordance with the invention and which had a uniform temperature distribution property. The cast bearing was quenched and subjected to a microscopic surface examination which showed a very uniform and excellent metal surface structure. When a conventional inductive body was used under the same conditions as that of the above experiment, it was clearly observed that the surface structure of the latter product was much inferior to that of the former product.

As is apparent from the foregoing, roughly the same amount of density of magnetic flux is applied to the collar portions and the body portion of the article to be heated if the notched portions according to the invention are arranged on the inductive body.

This invention comprises a novel notched portion provided on the conventional inductive body for high-frequency heating, and shape, size, number, position, and other factors of said notched portion may be suitably chosen to substantially equalize the density of magnetic flux applied to the collar portion and the body portion of the article to be heated. Therefore, the indispensable structural part of the gapped portion according to the invention may be defined as a gapped portion adapted to decrease the density of magnetic flux at the collar portion of the work piece. As described in the foregoing, this invention is able to provide an inductive body in which a more improved result can be obtained in comparision with a case where a conventional inductive body for high-frequency heating is used.

I claim:

1. A single-layer cylindrical induction coil for high-frequency heating of a cylindrical metal work piece for making slide bearing having at least an end collar on the circumference at the axial end thereof; the induction coil completely surrounding the work piece, the axial length of the induction coil being equal to that of the work piece, and having at least at the axial end thereof opposing to the end collar of the work piece which is rotatable during heating a portion defining at least a rectangular notch axial length $x$ of which is in a range of from one third to four times the axial length of the collar of the work piece while the circumferential length $y$ or sum of the circumferential lengths $y$ of said rectangular notch or notches are in a range of one quarter to three quarters of the length of the circumference of the induction coil.

2. A single-layer cylindrical induction coil for high frequency heating of a cylindrical metal work piece for making slide bearing having at least a collar in the circumference thereof; the induction coil completely surrounding the work piece, the axial length of the induction coil being equal to that of the work piece, and having in the circumference thereof opposing to the collar of the work piece which is rotatable during heating a portion defining at least an aperture axial length $x$ of which is in the range of from one third to four times the axial length of the collar of the work piece while the circumferential length of the aperture $y$ or the sum of the circumferential length of said apertures is in a range of from one quarter to three quarters of the circumferential length of the induction coil.

3. A hollow cylindrical inductive body according to claim 2, wherein the aperture having a single elliptical, semi-elliptical or circular shape and axis of the elliptical or semi-elliptical aperture in the axial direction $x$ or the diameter of the aperture of circular shape is in a range of from one third to four times the axial length of the collar of the work piece and further the opening area of the aperture lies within that obtained by the product of the values of $x$ and $y$ ($x \cdot y$) or the product of $x$ and $\Sigma\ y$ ($x \cdot \Sigma\ y$) defined as for rectangular notch or notches as recited in claim 2.

* * * * *